US007403131B2

(12) United States Patent
Gossett et al.

(10) Patent No.: US 7,403,131 B2
(45) Date of Patent: Jul. 22, 2008

(54) POWER TOOL MOVEMENT MONITOR AND OPERATING SYSTEM

(75) Inventors: Timothy J. Gossett, St. Louis, MO (US); Donald R. Ladwig, St. Charles, MO (US); Frank G. Speno, Glendale, MO (US)

(73) Assignee: The Boeing Company, Chicago, IL (US)

( * ) Notice: Subject to any disclaimer, the term of this patent is extended or adjusted under 35 U.S.C. 154(b) by 267 days.

(21) Appl. No.: 11/157,727

(22) Filed: Jun. 21, 2005

(65) Prior Publication Data

US 2007/0008162 A1 Jan. 11, 2007

(51) Int. Cl.
*G08B 21/00* (2006.01)

(52) U.S. Cl. ..... 340/680; 30/382; 701/47; 340/683

(58) Field of Classification Search ..... 340/680, 340/683; 30/382; 701/47; 173/20, 21
See application file for complete search history.

(56) References Cited

U.S. PATENT DOCUMENTS 4,260,092 A 4/1981 Austin
4,298,072 A 11/1981 Baker et al.
4,309,902 A * 1/1982 Sano et al. ..... 73/159
4,543,577 A * 9/1985 Tachibana et al. ..... 340/904
4,642,617 A * 2/1987 Thomas et al. ..... 340/680
4,794,273 A 12/1988 McCullough et al.
4,853,680 A * 8/1989 Thomas ..... 340/680
5,014,154 A 5/1991 White
5,194,848 A * 3/1993 Kerr ..... 340/566
5,401,928 A 3/1995 Kelley
5,415,263 A 5/1995 Bessette
5,490,081 A 2/1996 Kuromoto et al.
5,525,935 A * 6/1996 Joo et al. ..... 331/11
5,526,915 A 6/1996 Bessette et al.
5,534,854 A * 7/1996 Bradbury et al. ..... 340/648
6,272,412 B1 * 8/2001 Wu et al. ..... 701/47
6,970,095 B1 * 11/2005 Lee et al. ..... 340/669
2004/0181951 A1 * 9/2004 Wittke ..... 30/382
2004/0252397 A1 12/2004 Hodge et al.

* cited by examiner

*Primary Examiner*—George A Bugg
*Assistant Examiner*—Hoi C Lau
(74) *Attorney, Agent, or Firm*—Lee & Hayes, PLLC

(57) ABSTRACT

A power tool movement monitor system including a first accelerometer operatively configured to sense movement along a first axis of a power tool and a first high pass filter operatively connected to the output of the first accelerometer. The first high pass filter has an output and a cutoff frequency corresponding to a predetermined acceleration limit capable of being output by the first accelerometer. The power tool movement system further includes a logic circuit operatively configured to generate a warning signal when the first high pass filter outputs a signal having a frequency equaling or exceeding the cutoff frequency of the first high pass filter.

18 Claims, 12 Drawing Sheets

POWER TOOL MOVEMENT MONITOR AND OPERATING SYSTEM

BACKGROUND OF THE INVENTION

The present invention relates to power tools, and, more particularly, to methods and systems for monitoring the movement of a power tool to detect non-operational condition.

Construction and industrial accidents involving power hand tools, such as nail guns, are increasing. Currently, eight percent of all industrial accidents involve the use of hand tools. In the construction industry, injuries involving nail guns account for more than half of worker compensation claims. Typically, nail gun injuries result from the improper movement of the nail gun, such as swinging the nail gun laterally into the user's leg when walking or dropping the nail gun onto the floor causing a nail to be shot out of the gun, potentially causing damage to property or hitting people nearby.

Furthermore, stationary power tools, such as drill presses or shop machines used in manufacturing, often vibrate or chatter after extended use. In addition, controlled systems that are under closed loop control often are subjected to loss of control, which can lead to full torque when the control or acceleration commands loop malfunctions causing the potential for damage to system components.

Therefore, a need exists for systems and methods that overcome the problems noted above and others previously experienced for monitoring the movement of a power tool to detect certain operating conditions and to power off the tool when the certain conditions are detected.

SUMMARY OF THE INVENTION

In accordance with methods consistent with the present invention, a method for monitoring the movement of a power tool or controlled system (hereafter referred to as a power tool) is provided.

In accordance with systems consistent with the present invention, a power tool movement monitor system is provided. The power tool movement monitor system includes a first accelerometer operatively configured to sense movement along a first axis of a power tool and a first high pass filter operatively connected to the output of the first accelerometer. The first high pass filter has an output and a cutoff frequency corresponding to a predetermined acceleration limit capable of being output by the first accelerometer. The power tool movement monitor system also includes a logic circuit operatively configured to generate a warning signal when the first high pass filter outputs a signal having a frequency equaling or exceeding the cutoff frequency of the first high pass filter.

In accordance with systems consistent with the present invention, another implementation of a power tool movement monitor system is provided. The power tool movement monitor system includes a first accelerometer operatively configured to sense movement along a first axis of a power tool and a first low pass filter operatively connected to the output of the first accelerometer. The first low pass filter has an output and a cutoff frequency corresponding to a predetermined acceleration limit capable of being output by the first accelerometer. The power tool movement monitor system also includes a logic circuit operatively configured to generate a warning signal when the first low pass filter outputs a signal having a frequency equal to or less than the cutoff frequency of the first low pass filter.

In accordance with systems consistent with the present invention, another implementation of a power tool movement monitor system is provided. The power tool movement monitor system includes a plurality of accelerometers, each having an output and each being operatively configured to sense movement along a respective axis of a power tool. The power tool movement monitor system further includes means for determining whether movement sensed by one of the accelerometers equals or exceeds a predetermined limit, and means for preventing the power tool from operating in response to determining the movement sensed by the one accelerometer equals or exceeds the predetermined limit.

Other systems, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Reference will now be made in detail to an implementation in accordance with methods, systems, and products consistent with the present invention as illustrated in the accompanying drawings. The same reference numbers may be used throughout the drawings and the following description to refer to the same or like parts.

In accordance with methods and systems consistent with the present invention, a power tool movement monitor system is provided that is able to disrupt the action or operation of the tool when the power tool movement monitor system determines that movement of the tool exceeds a predetermined limit (e.g., a predetermined acceleration limit or a predetermined velocity limit), which may be predefined for the tool and its field of use. As discussed below, the predetermined acceleration limits and the predetermined velocity limits may derived for each orthogonal axis of the power tool to define an operating regime the power tool so the movement monitor system may be calibrated in accordance with the operating regime to inhibit operation of the power tool or the active mechanism (e.g., nail projector, saw blade, etc.) outside of the operating regime.

Figure 1:
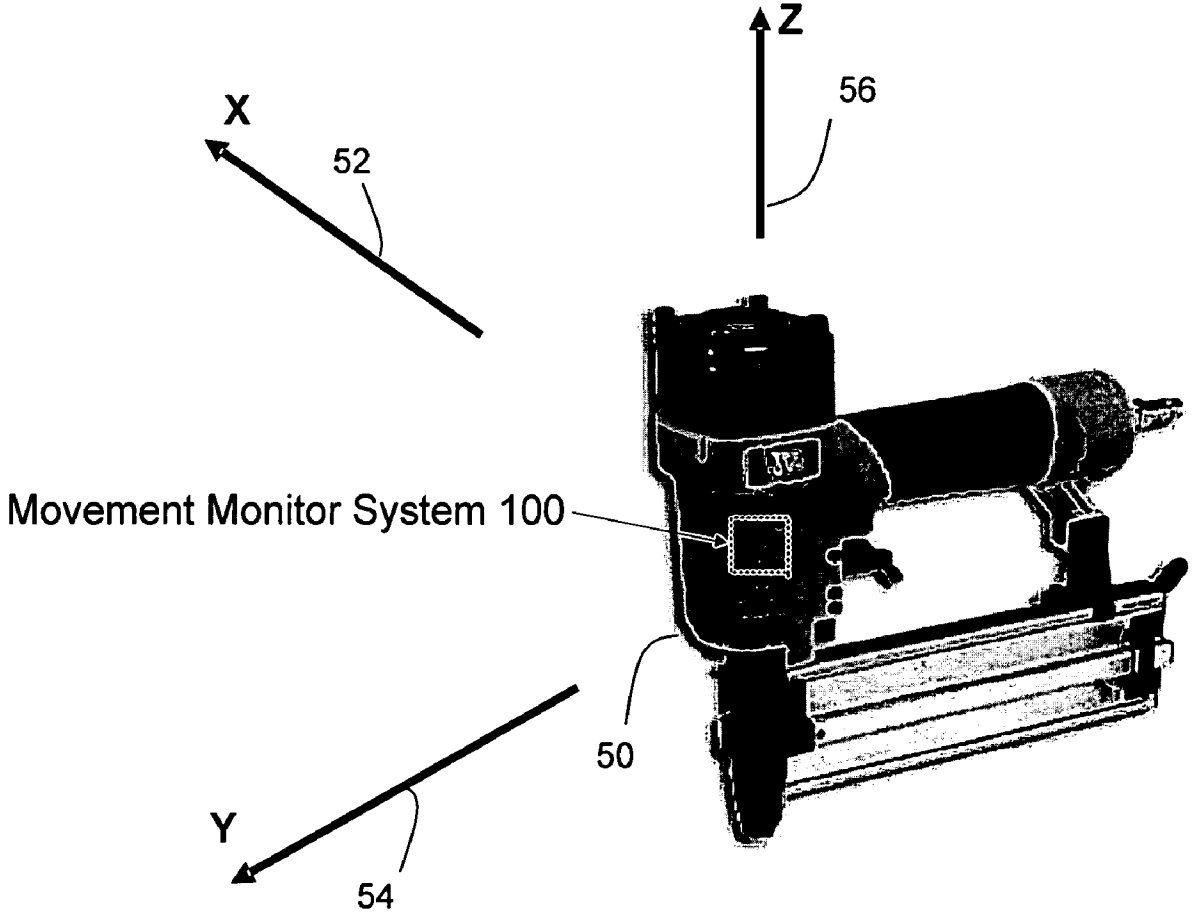
FIG. 1 depicts a diagram of a power tool having an exemplary movement monitor system consistent with the present invention.

FIG. 1 depicts a diagram of a power tool 50 having an exemplary movement monitor system 100 consistent with the present invention. In this example, the power tool 50 is a nail gun. However, the movement monitor system 100 may be implemented in or on any hand power tool (e.g., staple gun, circular saw, router, etc.), stationary power tool (e.g., drill press, band saw, lathe, etc.), or closed loop controlled system (gimbaled mirror, crane arm, etc.). In addition, power tool 50 (or controlled loop controlled system) may be powered by any known power source, such as electric, pneumatic, or hydraulic.

Table 1 provides an exemplary operational regime for operating the tool 50 in accordance with methods and systems consistent with the present invention. The values of the acceleration and velocity limits for the exemplary operational regime depicted in Table 1 are provided for clarity in the discussion and do not limit the scope of the present invention.

TABLE 1

| | |
|---|---|
| X-axis predetermined acceleration limit | <200 Hz |
| X-axis predetermined velocity limit | <1 ft/sec for 2 seconds |
| Y-axis predetermined acceleration limit | <200 Hz |
| Y-axis predetermined velocity limit | <1 ft/sec for 2 seconds |
| Z-axis predetermined acceleration limit | <1200 Hz |
| Z-axis predetermined velocity limit | <1 ft/sec for 2 seconds |

As discussed below, the movement monitor system 100 of the power tool 50 may be calibrated in accordance with the operational regime depicted in Table 1 so that the movement monitor system 100 detects angular or orthogonal movement outside the operational regime.

Figure 2:
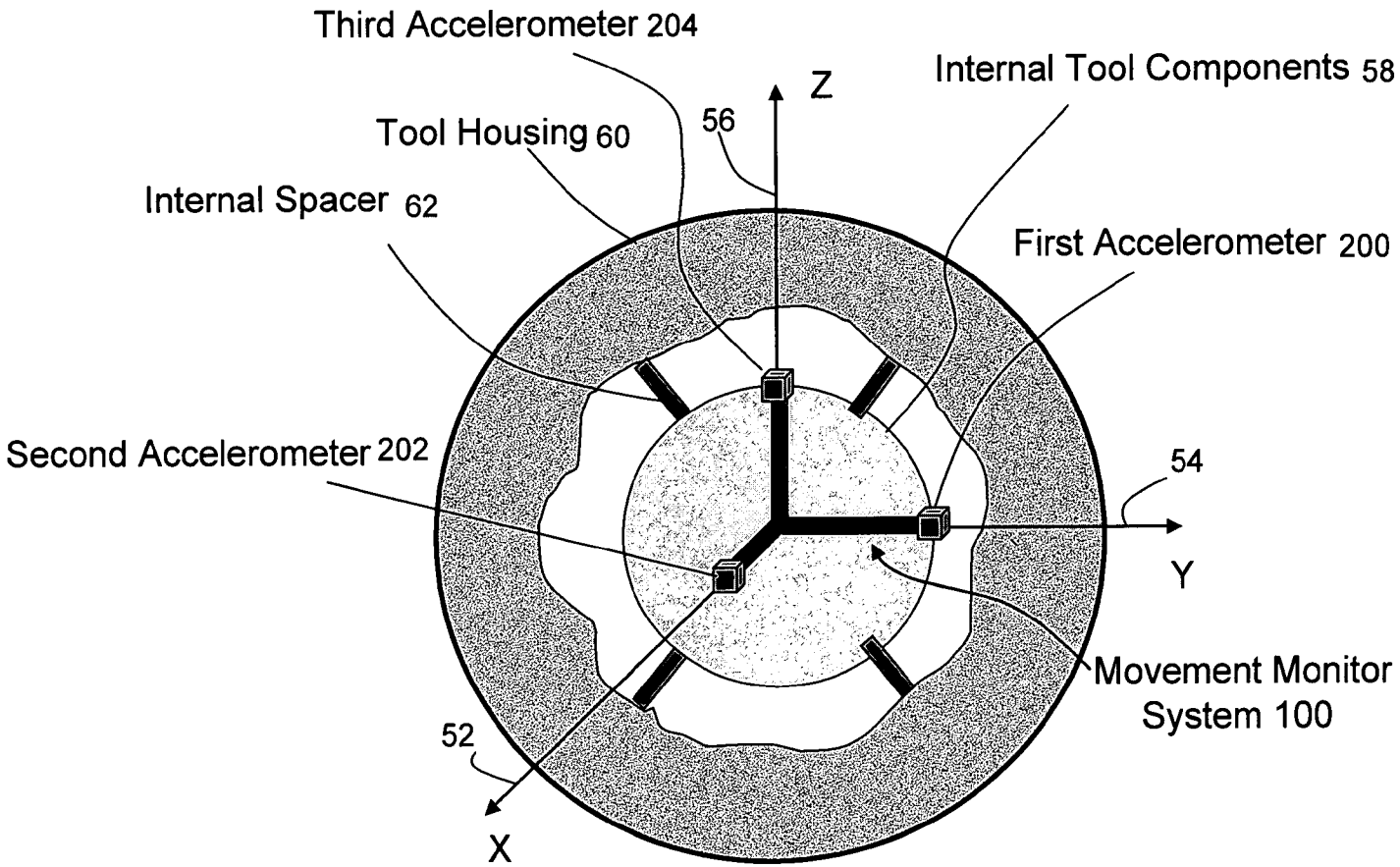
FIG. 2 depicts an exemplary cross-sectional view of the power tool of FIG. 1 illustrating one implementation in which the movement monitor system is attached to internal components of the tool.

The movement monitor system 100 is mounted or attached to the power tool 50 such that the system 100 is oriented in relationship to one or more of the physical axes 52, 54, and 56 of the tool 50 so the system 100 is able to monitor movement, such as an acceleration or velocity, along or around, one or more of the tool's physical axes 52, 54, and 56. FIG. 2 depicts an exemplary cross-sectional view along a plane perpendicular to the z-axis 56 of the power tool 50 shown in FIG. 1. The cross-sectional view in FIG. 2 illustrates one implementation in which the movement monitor system 100 is attached to internal components 58 (e.g., motor, actuators, circuit boards, etc.) of the tool 50. In the example shown in FIG. 2, the power tool 50 has a housing 60 connected to the internal components via spacers 62. In this implementation, the power tool 50 may ring or vibrate with a high frequency component when a sudden force or acceleration, such as a free fall from a table top, is applied to the tool 50 that is not damped by the controlled operation of the tool operator. The high frequency component is often on the order of 100 Hz or greater in the absence of the damping affect applied by a tool operator. When the tool 50 is under the control of an operator, the damping provided to the tool reduces the acceleration on the order of 10 Hz or less. However, even at these low frequencies, the tool operator may not be operating the tool 50 properly. For example, when the power tool 50 is a nail gun, movement over a period of time in the x-axis 52 or y-axis 54 addition, may indicate uncontrolled operation of the tool. For example, the tool operator may accidentally carry the power tool 50 while it is powered on or operational. As described in detail below, the movement monitor system 100 is able to monitor for an acceleration or velocity along each axis 52, 54, and 56 of the tool 50 and generate a warning signal when the monitored acceleration or velocity exceeds a predetermined acceleration or velocity limit for the respective axis 52, 54, and 56 as shown in Table 1. The movement monitor system may include a logic circuit that uses the warning signal to switch power off to the tool 50 or to the active mechanism of the tool 50, such as the nail projector of a nail gun or the saw blade of a table saw. The logic circuit may also use the warning signal to provide an audible alarm, or provide a visual alarm.

As shown in FIG. 2, the movement monitor system 100 has a first accelerometer 200 operatively configured to sense movement along a first axis (e.g., the x-axis 52) of the power tool 50. The movement monitor system 100 may also have a second accelerometer 202 operatively configured to sense movement along a second axis (e.g., the y-axis 54) of the power tool 50 and a third accelerometer 204 operatively configured to sense movement along a third axis (e.g., the z-axis 56) of the power tool 50. When movement is sensed, each accelerometer 200, 202, and 204 outputs a corresponding detected signal. In one implementation, the first, second, and third axes 52, 54, and 56 are orthogonal to each other. The accelerometers 200, 202, and 204 may be incorporated into a three axis solid state accelerometer device (302 in FIG. 3). Alternatively, the accelerometers 200, 202, and 204 may be discrete components, which may be positioned in or on the tool 50 in alignment with a respective physical axis 52, 54, and 56 of the tool 50. Furthermore, although the movement monitor system 100 is depicted as being attached to the internal tool components 58, the system 100 may be mounted on the tool housing 60 or on one of the spacers 62.

Figure 3:
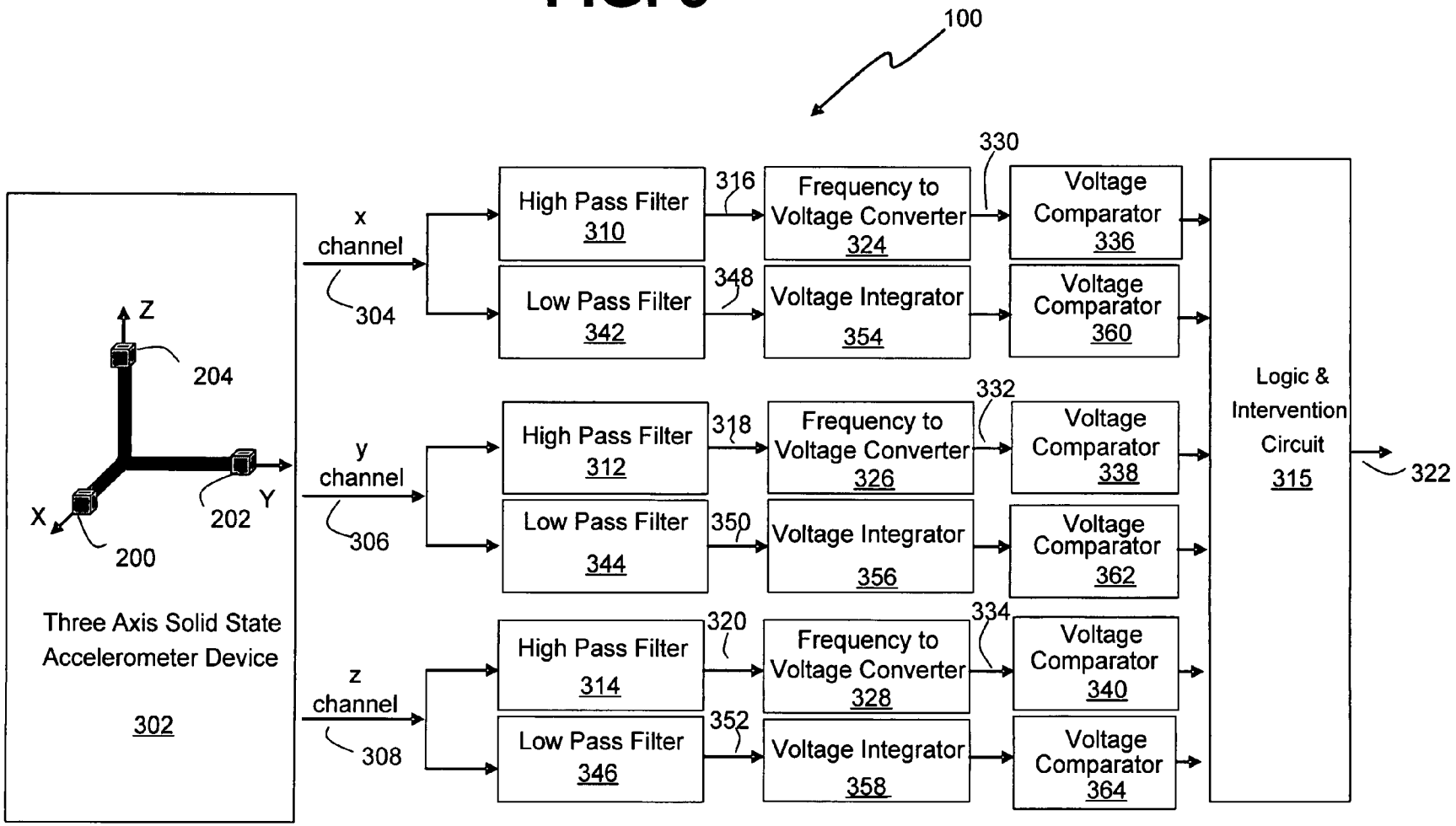
FIG. 3 depicts an exemplary schematic block diagram of the movement monitor system of FIG. 1.

FIG. 3 depicts an exemplary schematic block diagram of the movement monitor system 100. In this implementation, the first, second, and third accelerometers 200, 202, and 204 of the system 100 are incorporated into a three axis accelerometer device 302. Each of the accelerometers 200, 202, and 204 has a respective channel or output 304, 306, and 308.

The system 100 also includes one or more high pass filters 310, 312, and 314 and a logic circuit 315. Each high pass filter 310, 312, and 314 is operatively connected to the output 304, 306, or 308 of a respective one of the accelerometers 200, 202, or 204. Each high pass filter 310, 312, and 314 has an output 316, 318, and 320 operatively connected to the logic circuit 315 and a cutoff frequency corresponding to a respective one of a plurality of predetermined acceleration limits associated with the axes 52, 54, or 56 of the power tool 50 (e.g., as shown in Table 1). The predetermined acceleration limits may be identified by the manufacturer of the power tool 50 or by a designer implementing the movement monitor system 100 into an existing power tool 50. The predetermined acceleration limits may be derived from empirical data obtained from typical use and operation of the power tool 50 having the movement monitor system 100.

For example, when the power tool 50 is a nail gun, the movement monitor system 100 may be calibrated in accordance with the operational regime depicted in Table 1 such that the system 100 senses high frequency acceleration along the z-axis 56 or the axis along which the nail gun is typically moved in order to cause a nail to be ejected from the nail gun. Thus, in this example, the predetermined acceleration limit for movement along the z-axis 56 of the nail gun may correspond to a high frequency acceleration of 1200 Hz associated with the movement sensed by the accelerometer 204. The high pass filter 314 (e.g., the first high pass filter) may then be designed or calibrated to have a cutoff frequency of 1200 Hz, allowing a portion of the detected signal from the accelerometer 204 that has a frequency equal to or greater than the cutoff frequency to pass or be output by the high pass filter 314. As further discussed below, the logic circuit 315 is operatively configured to generate a warning signal 322 when the high pass filter 314 outputs a signal having a frequency equaling or exceeding the cutoff frequency of the high pass filter 314.

Continuing with this example, the movement monitor system 100 should not expect to sense high frequency acceleration in the x-axis 52 or y-axis 54 if the nail gun is being operated properly. Thus, in this example, the predetermined acceleration limit for the x-axis 52 and y-axis 54 may correspond to a frequency acceleration limit of 200 Hz associated with the movement sensed by the accelerometers 200 and 202. The high pass filters 310 and 312 may then be designed or calibrated to have a cutoff frequency of 200 Hz, allowing a portion of the detected signal from the respective accelerometer 200 and 202 that has a frequency equal to or greater than the cutoff frequency to pass or be output by the respective high pass filter 310 and 312. In this implementation, the logic circuit is operatively configured to generate the warning signal when one of the high pass filters 310, 312, or 314 outputs a signal having a frequency equaling or exceeding the cutoff frequency of the respective high pass filter.

In another implementation, the operational regime of the power tool 50 may identify a predetermined velocity or acceleration rotational limitation about one or more of the axes 52, 54, and 56. In this implementation, the movement monitor system 100 may be configured to monitor the detected signals from two or more of the accelerometers 200, 202, and 204 to detect when the predetermined velocity or acceleration rotational limitation is exceeded in accordance with methods and systems consistent with the present invention.

Figure 4:
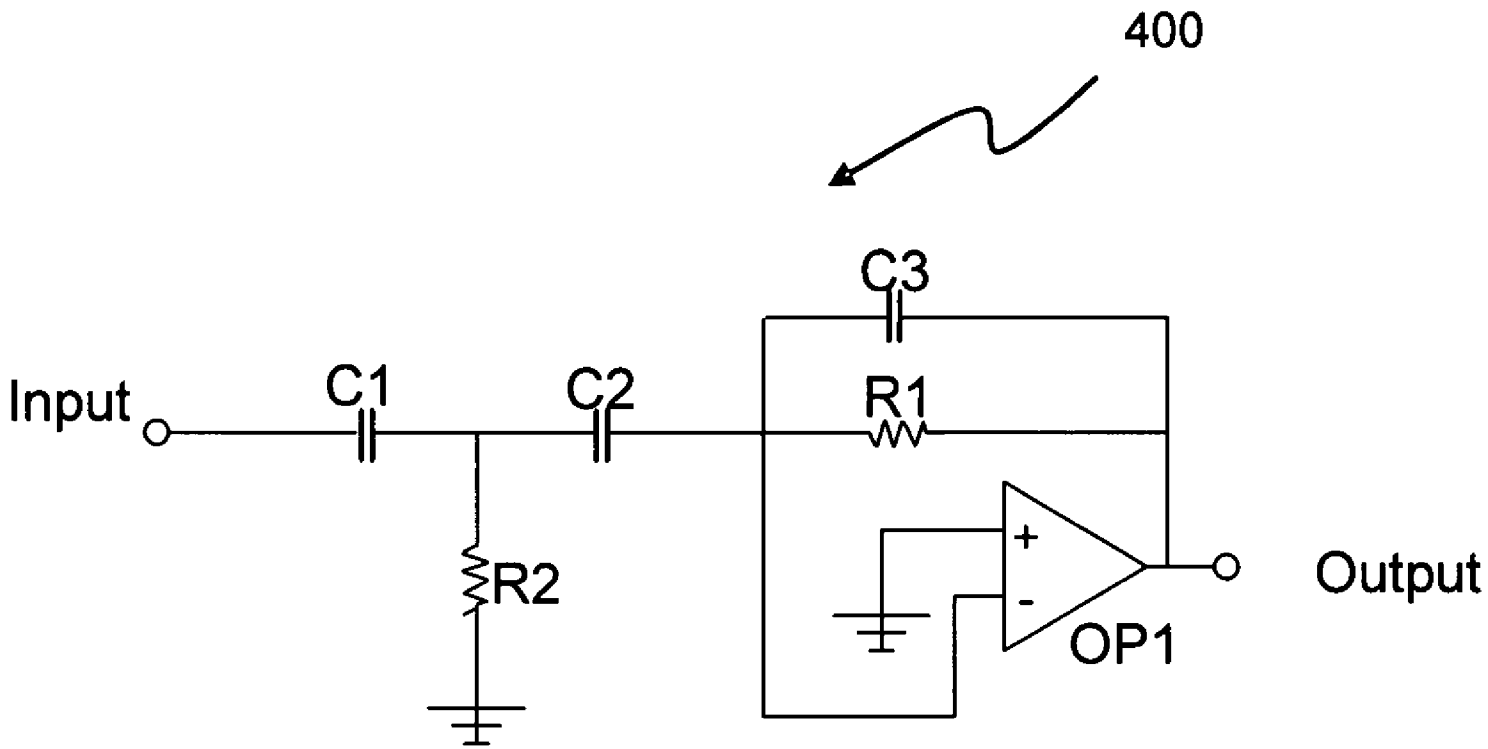
FIG. 4 depicts a schematic diagram of an exemplary high pass filter suitable for use in the movement monitor system of FIG. 1 in accordance with the present invention.

FIG. 4 depicts a schematic diagram of an exemplary high pass filter 400 suitable for use in the movement monitor system 100 for each of the high pass filters 310, 312, and 314 in accordance with the present invention. The high pass filter 400 is a 2-pole Chebyshev high pass filter having a steep cutoff in the high pass band of the filter. However, each of the high pass filter 310, 312, and 314 may be any standard high pass filter having a cutoff frequency that may be set for a high frequency cutoff (e.g., 200 Hz or 1200 Hz) in accordance with the predefined acceleration limits for the tool axes 52, 54, and 56 during operation of the power tool 50.

Returning to FIG. 3, the system 100 may also include one or more frequency-to-voltage converters 324, 326, and 328; each operatively connected between a respective one of the high pass filters 310, 312, and 314 and the logic circuit 315. Each frequency-to-voltage converter 324, 326, and 328 is operatively configured to convert the output signal 316, 318, or 320 from the respective high pass filters 310, 312, and 314 to a corresponding DC voltage output 330, 332, and 334 that is directly proportional to the frequency of the output signal 316, 318, or 320. In a preferred implementation, the output signal 316, 318, or 320 from each high pass filter 310, 312, and 314 includes only the high frequency component or portion of the detected signal output by the respective accelerometer 200, 202, and 204 based on movement sensed in the respective axis 52, 54, and 56 of the power tool 50. When the cutoff frequency of each high pass filter 310, 312, and 314 is set to correspond to the predetermined acceleration limit for movement along the respective axis 52, 54, and 56 of the power tool 50, the high frequency output signal 316, 318, and 320 may indicate uncontrolled operation after a disruptive event in the use of the power tool 50.

Figure 5:
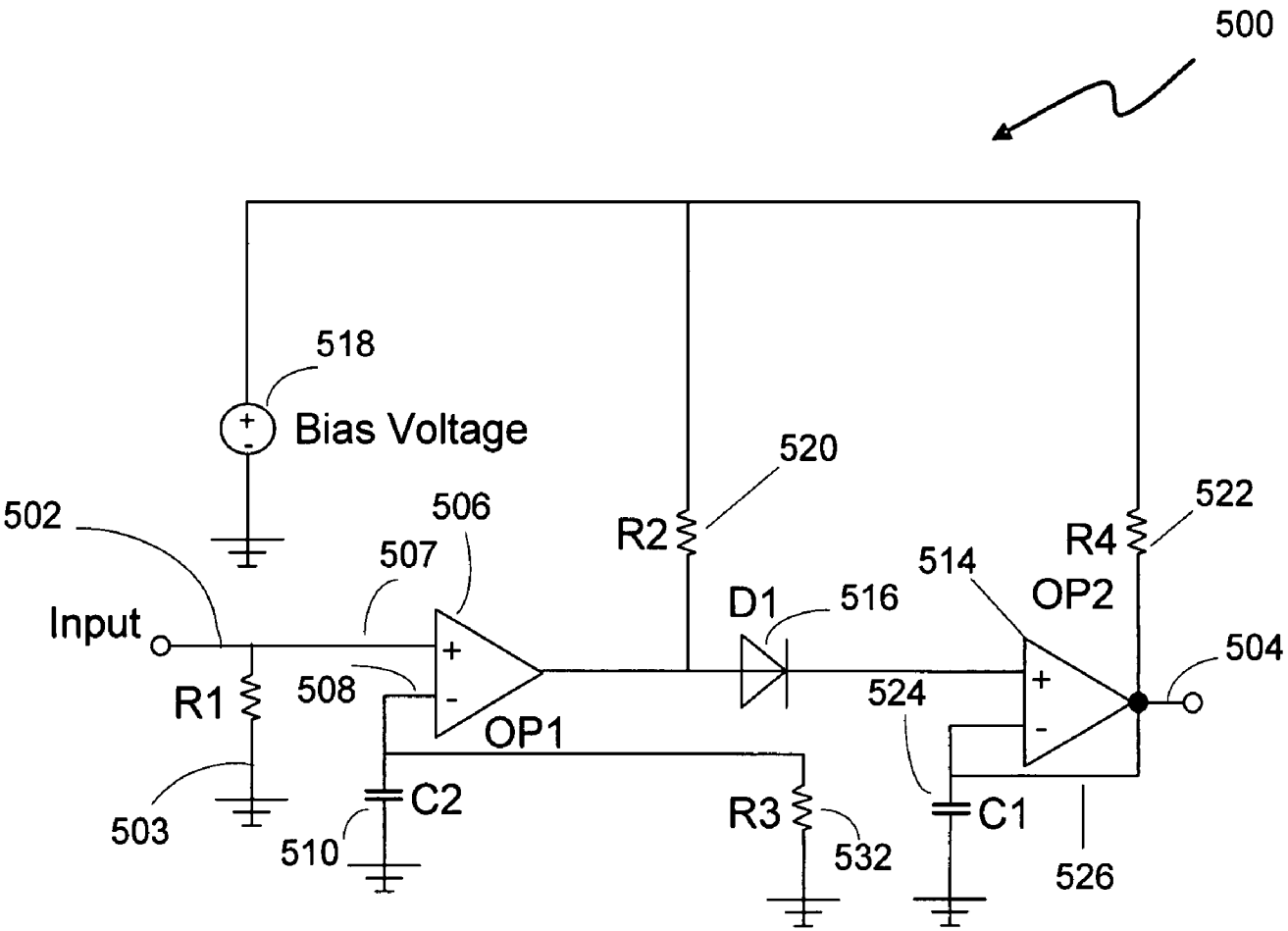
FIG. 5 depicts a schematic diagram of an exemplary frequency-to-voltage converter suitable for use in the movement monitor system of FIG. 1 in accordance with the present invention.

FIG. 5 depicts a schematic diagram of an exemplary frequency-to-voltage converter 500 suitable for use in the movement monitor system 100 for each of the frequency-to-voltage converters 324, 326, and 328 in accordance with the present invention. However, each of the frequency-to-voltage converters 324, 326, and 328 may be any standard frequency-to-voltage converter, such as the ADVFC32 converter commercially available from Analog Devices, that is operatively configured to generate a DC voltage output 330, 332, and 334 that is directly proportional to an AC input signal (e.g., output signal 316, 318, or 320 from the high pass filters 310, 312, and 314) within a predetermined frequency range.

In the implementation shown in FIG. 5, the input signal 502 corresponds to the output signal 316, 318, or 320. The output signal 504 is a DC voltage proportional to the frequency of the input signal 502. The frequency-to-voltage converter 500 includes a first amplifier 506 having a first input 507 operatively configured to receive the input signal 502 (that may be attenuated by a first resistor 503) and a second input 508 operatively connected to a first capacitor 510 and a second resistor 512 in parallel with the first capacitor 510. The frequency-to-voltage converter 500 also includes a second amplifier 514 operatively configured to output the output signal 504, and a diode 516 operatively connected between the first amplifier 506 and the second amplifier 514. In addition, the frequency-to-voltage converter 500 includes a bias voltage 518 operatively connected to the first amplifier 506 and to the diode 516 via a third resistor 520. The bias voltage 518 may also be operatively connected to the output of the second amplifier 514 via a fourth resistor 522.

In this implementation, when the input signal 502 oscillates from a negative value and to a positive value, the capacitor 510 is charged with a voltage proportional to the input signal 502 voltage change based on current flowing from the bias voltage 508 through resistors 512 and 520. As the input signal 502 voltage increases, the charge in the capacitor 510 approaches the value of the bias voltage 518 such that the diode 516 will cut off or open the connection between the first amplifier 506 and the second amplifier 514. At this point, the capacitor 510 will discharge creating a one-shot voltage source at the input to the second amplifier 514. The output signal 504 of the second amplifier 514 will follow the discharge voltage from the capacitor 510, but at the same time will be integrated in the time domain by a second capacitor 524 connected to the output signal 504 via a feedback loop 526 of the second amplifier 514. Accordingly, in implementation shown in FIG. 5, the output signal 504 will be a DC voltage that is proportional to the rate of bipolar oscillation in the input signal 502.

Figure 6:
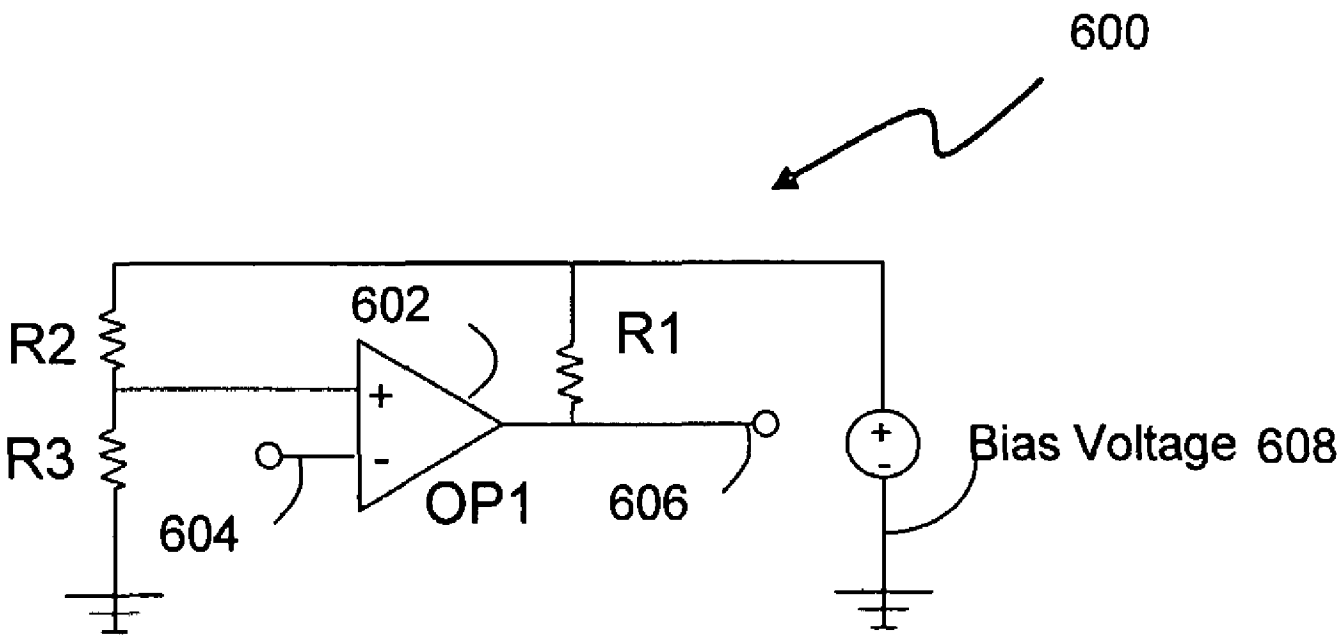
FIG. 6 depicts a schematic diagram of an exemplary voltage comparator suitable for use in the movement monitor system of FIG. 1 in accordance with the present invention.

The system 100 may also include one or more voltage comparators 336, 338, and 340 operatively connected between a respective frequency-to-voltage converter 324, 326, and 328 and the logic circuit 315. FIG. 6 depicts a schematic diagram of an exemplary voltage comparator 600 suitable for use in the movement monitor system for each of the voltage comparators 336, 338, and 340 in accordance with the present invention. In the implementation shown in FIG. 6, the voltage comparator 600 includes an operational amplifier 602 having an input 604 that may be operatively connected to the output 330, 332, or 334 of a respective frequency-to-voltage converter 324, 326, and 328 and an output 606 operatively connected to a bias voltage 608 corresponding to the predetermined acceleration limit for the x-axis 52, y-axis 54, or z-axis 56 of the power tool. The voltage comparator 600 is operatively configured to convert a signal present on the input 604 (e.g., DC voltage signal 330, 332, or 334) to a first digital signal (e.g., an active high logic signal) representing a TRUE condition when the input signal 604 is equal to or exceeds the bias voltage 608 or to a second digital signal (e.g., active low logic signal) representing a FALSE condition when the input signal 604 is less than the bias voltage 608. In this implementation, the logic circuit 315 is operatively configured to generate the warning signal 322 when one of the voltage comparators 336, 338, or 404 outputs a digital signal representing a TRUE condition.

In another implementation, the movement monitor system 100 may be operatively configured to monitor movement corresponding to a velocity along one or more of the tool's axes 52, 54, and 56 and to generate the warning signal 322 when the velocity exceeds a predetermined velocity limit for the respective axis 52, 54, or 56. As discussed below, the predetermined velocity limit as shown in Table 1 may identify a limit for permissible low frequency gross movement (e.g., angular or orthogonal movement along an axis) of the tool 50. The predetermined velocity limit may be derived from one of the predetermined acceleration limits for each axis 52, 54, or 56 over a predefined period. For example, when the power tool 50 is a hand tool such as a nail gun, the operator of the power tool 50 may move the tool 50 at low frequency or constant acceleration in a direction (e.g., the y-axis 54) corresponding to a velocity indicating an uncontrolled operation that is inconsistent with the intended use of the tool 50. Thus, the movement monitor system 100 may then generate the warning signal 322 to alert the operator or to inhibit the operation of the tool 50 as discussed below.

In this implementation, the system 100 includes one or more low pass filters 342, 344, and 346 and one or more voltage integrators 354, 356, and 358. Each low pass filter 342, 344, and 346 is operatively connected to the output 304, 306, or 308 of a respective one of the accelerometers 200, 202, or 204. Each low pass filter 342, 344, and 346 has an output 348, 350, and 352 and a cutoff frequency corresponding to a respective one of the plurality of predetermined acceleration limits associated with the axes 52, 54, and 56 of the power tool 50. Each voltage integrators 354, 356, and 358 is operatively connected between the output 348, 350, and 352 of a respective one of the low pass filters 342, 344, and 346 and the logic circuit 315. As discussed below, one of a plurality of predetermined velocity limits may be identified for each axis 52, 54, and 56 of the tool 50. Each predetermined velocity limit may be derived from one of the predetermined acceleration limits identified for the axes 52, 54, and 56 of the tool 50 for a predefined period. Alternatively, the predetermined velocity limits, like the predetermined acceleration limits, may be identified by the manufacturer of the power tool 50 or by a designer implementing the movement monitor system 100 into an existing power tool 50. The predetermined acceleration limits and the predetermined velocity limits may be derived from empirical data obtained from typical use and operation of the power tool 50 having the movement monitor system 100.

For example, if the power tool 50 is a hand tool such as a nail gun, the movement monitor system 100 may be configured to generate the warning signal 322 when the system 100 senses a low frequency acceleration that corresponds to a velocity for a predefined period in the x-axis 52, y-axis 54, or z-axis 56 of the power tool 50. Thus, the predetermined acceleration limit for each axis 52, 54, and 56 may correspond to a low frequency acceleration limit of 10 Hz, for example, associated with the movement sensed by the accelerometer 200, 202, or 204, which when integrated over the predefined period (e.g., two seconds) results in a corresponding predetermined velocity limit (e.g., less than 1 ft/sec) for the same predefined period. The low pass filters 342, 344, and 346 may then be designed or calibrated to have a cutoff frequency of 10 Hz, allowing a portion of the detected signal from the accelerometer 200, 202, or 204 having a frequency equal to or less than the cutoff frequency to pass or be output by the respective low pass filter 342, 344, and 346 to a respective one of the voltage integrators 354, 356, and 358. Each voltage integrator 354, 356, and 358 is operatively configured to integrate the low frequency signal output from the respective low pass filter 342, 344, and 346 and output a corresponding velocity for the predefined period. In this implementation, the logic circuit 315 is operatively configured to generate the warning signal 322 when the velocity output from one of the voltage integrators 354, 356, or 358 is equal to or exceeds the predetermined velocity limit (e.g., 1 ft/sec) that corresponds to the predetermined low frequency acceleration limit (e.g., 50 Hz) of the respective axis 52, 54, or 56 of the power tool 50 for the predefined period (e.g., 2 seconds).

Figure 7:
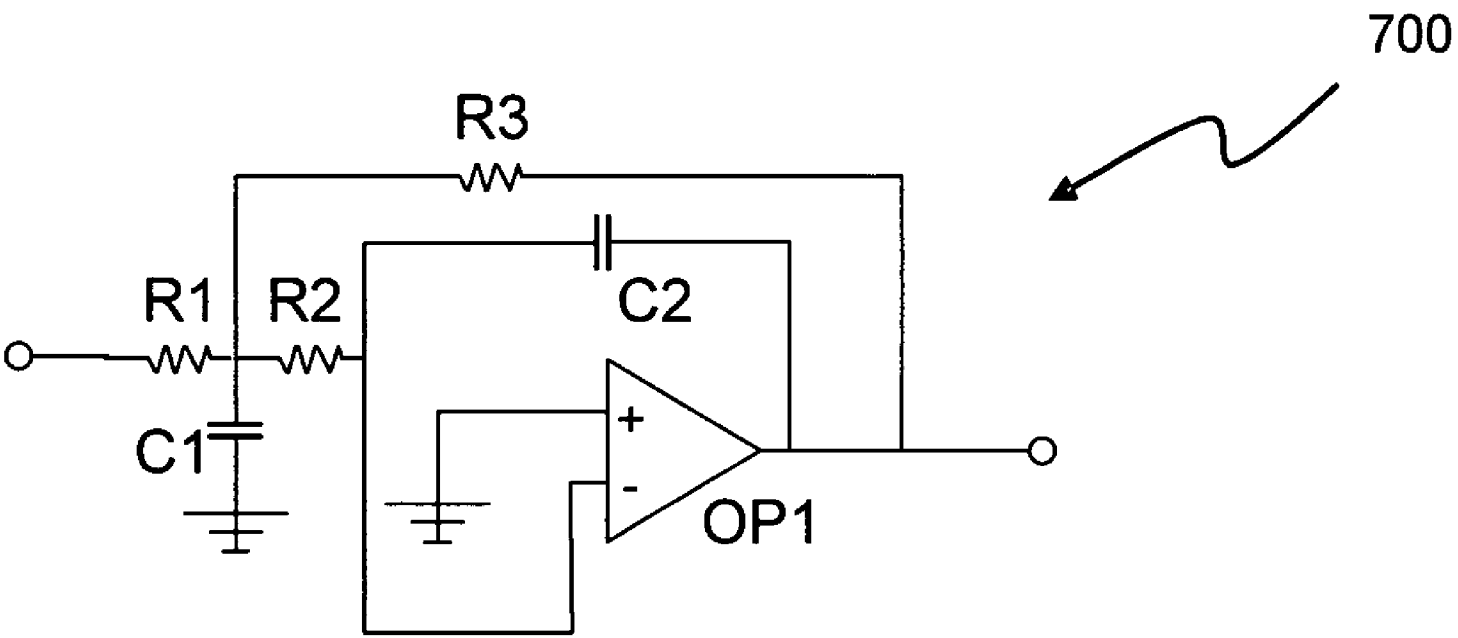
FIG. 7 depicts a schematic diagram of an exemplary low pass filter suitable for use in the movement monitor system of FIG. 1 in accordance with the present invention.

FIG. 7 depicts a schematic diagram of an exemplary low pass filter 700 suitable for use in the movement monitor system 100 for each of the low pass filters 342, 344, and 346 in accordance with the present invention. The low pass filter 400 is a 2-pole Chebyshev low pass filter having a steep cutoff in the low pass band of the filter. However, each of the low pass filters 342, 344, and 346 may be any standard low pass filter having a cutoff frequency that may be set for a low frequency cutoff (e.g., 10 Hz) in accordance with the predefined velocity limits for the tool axes 52, 54, and 56 during operation of the power tool 50.

Figure 8:
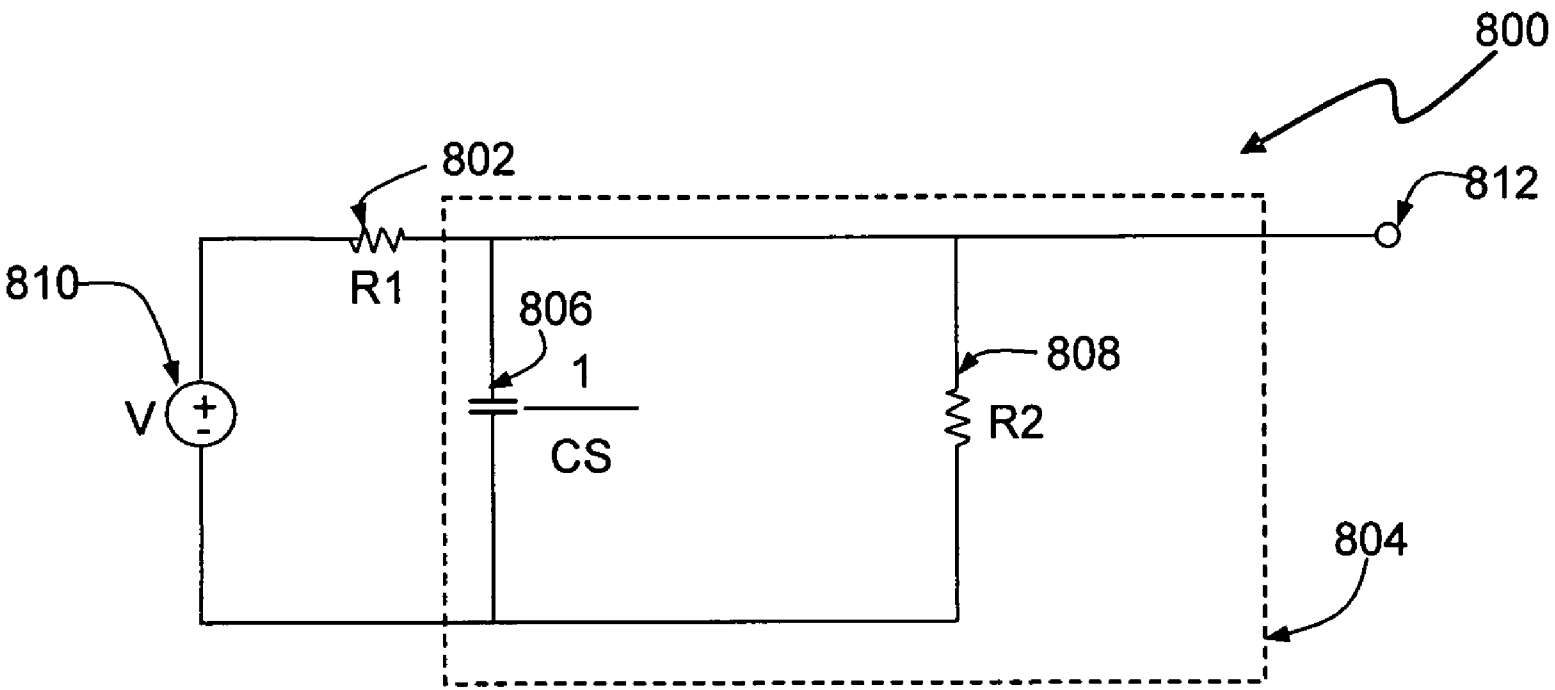
FIG. 8 depicts a schematic diagram of an exemplary voltage integrator suitable for use in the movement monitor system of FIG. 1 in accordance with the present invention.

FIG. 8 depicts a schematic diagram of an exemplary voltage integrator 800 suitable for use in the movement monitor system 100 for each of the voltage integrators 354, 356, and 358 in accordance with the present invention. As shown in FIG. 8, the voltage integrator 800 includes a first resistor 802 in series with an impedance 804, which may comprise a capacitor 806 in parallel with a second resistor 808. When a low frequency acceleration signal 810 is passed by one of the low pass filters 342, 344, or 346 to a respective voltage integrator 800 on the respective output 348, 350, or 352, the voltage integrator 800 integrates the low frequency acceleration signal 810 to generate a corresponding velocity signal 812 for the predefined period of the respective axis 52, 54, or 56 of the power tool 50. The voltage integrator 800 is calibrated for the predefined period of the respective axis 53, 54, or 56 by setting the time constant ($\tau$) of the voltage integrator 800 to the predefined period (e.g., 2 seconds). In the implementation shown in FIG. 8, the time constant ($\tau$) corresponds to Equation (1).

$$\tau = R_2 C \qquad \text{Equation (1)}$$

Thus, the time constant ($\tau$) may be set to the predefined period by selecting corresponding capacitor 806 and second resistor 808 to satisfy Equation (1). The integrated voltage signal 812 or V(t) may be derived from Equation (2) below where I(t) is the current flowing through $R_1$ at time t.

$$V(t)=I(t)R_1+I(t)[(1/C)e^{(1/(R_2C))1}] \quad \text{Equation (2)}$$

The system 100 may also include one or more voltage comparators 360, 362, and 364 operatively connected between a respective voltage integrator 354, 356, and 358 and the logic circuit 315. The voltage comparator 600 is also suitable for use in the movement monitor system for each of the voltage comparators 354, 356, and 358 in accordance with the present invention. In this implementation, the bias voltage 608 corresponds to the predetermined voltage limit over the predefined period for the x-axis 52, y-axis 54, or z-axis 56 of the power tool 50. Also, in this implementation, the voltage comparator 600 is operatively configured to convert a signal present on the input 604 (e.g., DC voltage signal 330, 332, or 334) to a first digital signal (e.g., active high logic signal) representing a TRUE condition when the input signal 604 equals or exceeds the bias voltage 608 or to a second digital signal (e.g., active low logic signal) representing a FALSE condition when the input signal 604 is less than the bias voltage 608. In this implementation, the logic circuit 315 is operatively configured to generate the warning signal 322 when one of the voltage comparators 354, 356, and 358 outputs a digital signal representing a TRUE condition.

Figure 9:
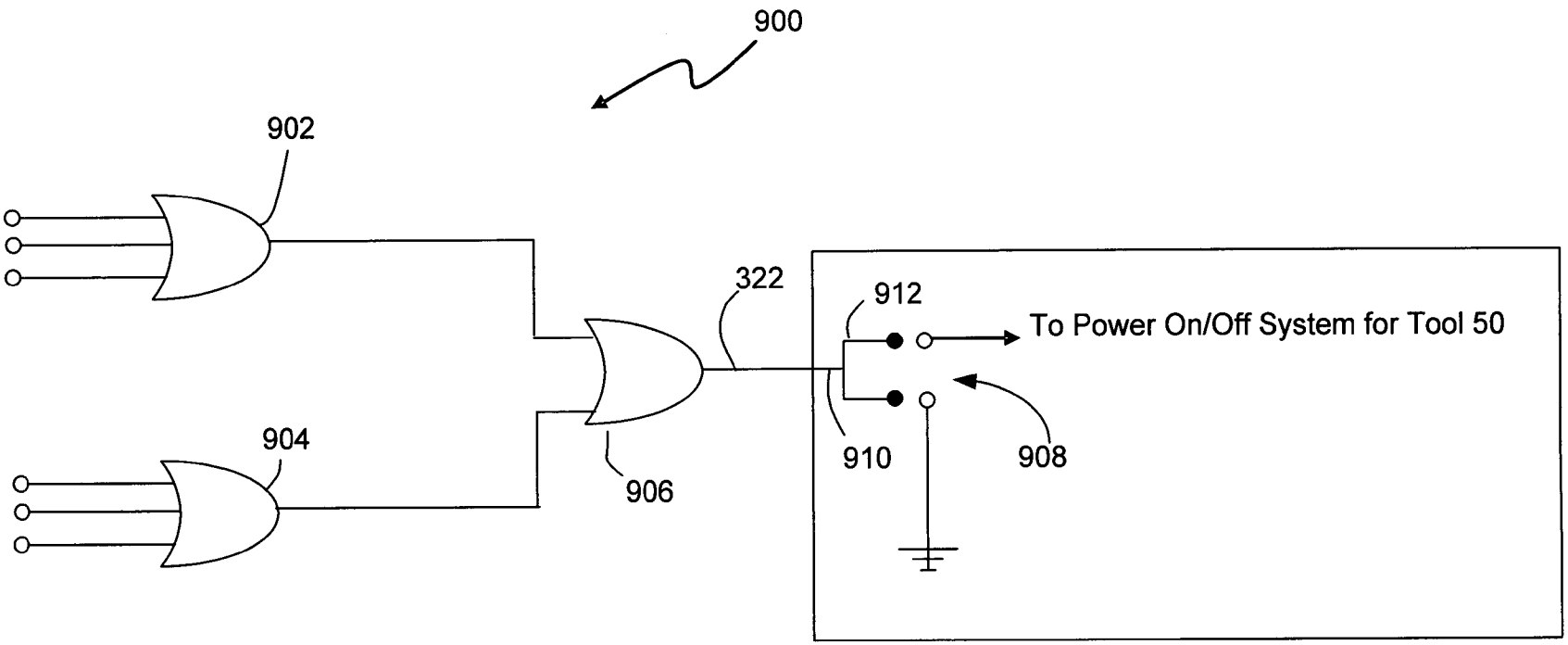
FIG. 9 depicts a schematic diagram of an exemplary logic circuit suitable for use in the movement monitor system of FIG. 1 in accordance with the present invention.

FIG. 9 depicts a schematic diagram of one implementation 900 of the logic circuit 315 for use in the movement monitor system 100 in accordance with the present invention. In this implementation, the logic circuit 900 has one or more logic OR gates 902, 904, and 906 operatively configured to receive the output from each voltage comparator 336, 338, 340, 360, 362, and 364 and logically OR them to determine if one or more of the processed signals of acceleration or velocity along a respective power tool axis 52, 54, and 56 equal or exceed the predetermined acceleration limit or the predetermined velocity limit for the respective axis 52, 54, and 56. When the logic circuit 900 determines one or more of the processed signals of acceleration or velocity along a respective power tool axis 52, 54, and 56 equal or exceed the predetermined acceleration limit or the predetermined velocity limit for the respective axis 52, 54, and 56, the logic circuit 900 generates the warning signal 922. In the implementation shown in FIG. 9, the logic circuit 900 includes a switch 908 having a control input 910 operatively connected to receive the warning signal 322 from the logic circuit 900 and an output 912 operatively connected to a power source of the power tool 50, such that the switch 908 turns off the power tool 50 or the active mechanism of the power tool 50 in response to receiving the warning signal 322 on the control input 910. Switch 908 may be a standard normally open or normally closed relay switch. In the implementation shown in FIG. 9, the switch 908 is a normally closed relay switch, which opens when the warning signal 322 is received on the control input 910. In this implementation, when the acceleration or velocity sensed by the system 100 falls below the respective predetermined acceleration limit or predetermined velocity limit for the power tool's axes 52, 54, and 56 in accordance with the present invention, the logic circuit 900 removes the warning signal 322 causing the switch 910 to close and allow the power tool 50 to operate again.

Figure 10:
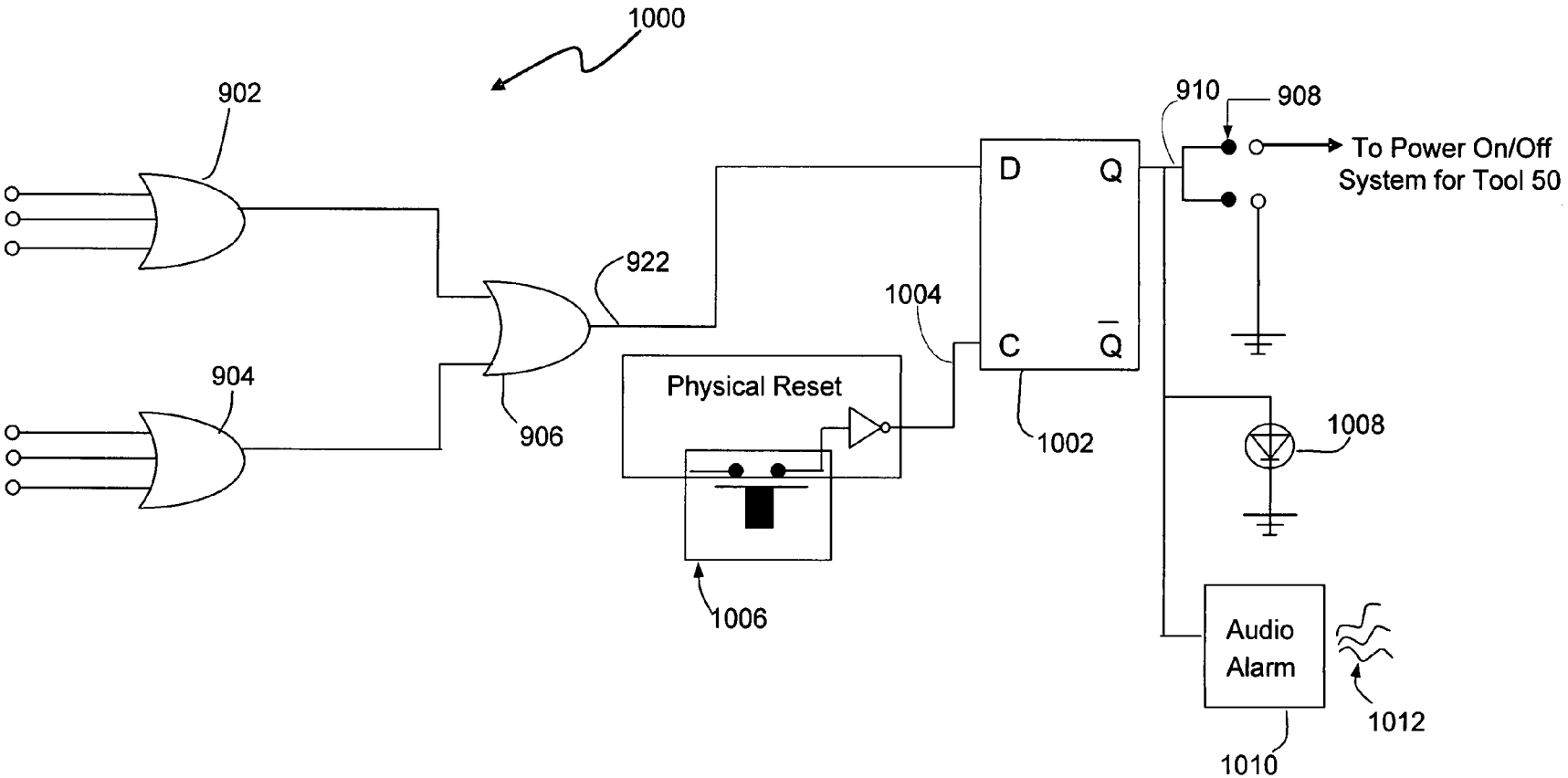
FIG. 10 depicts a schematic diagram of another exemplary logic circuit suitable for use in the movement monitor system of FIG. 1 in accordance with the present invention.

FIG. 10 depicts a schematic diagram of another implementation 1000 of the logic circuit 315 for use in the movement monitor system 100 in accordance with the present invention. In this implementation, the logic circuit 1000 has one or more logic OR gates 902, 904, and 906 that are operatively configured to receive the output from each voltage comparator 336, 338, 340, 360, 362, and 364 and logically OR them to determine if one or more of the processed signals of acceleration or velocity along a respective power tool axis 52, 54, and 56 are equal to or exceed the predetermined acceleration limit or the predetermined velocity limit for the respective axis 52, 54, and 56. When the logic circuit 1000 determines that one or more of the processed signals of acceleration or velocity along a respective power tool axis 52, 54, and 56 are equal to or exceed the predetermined acceleration limit or the predetermined velocity limit for the respective axis 52, 54, and 56, the logic circuit 1000 generates the warning signal 922. In the implementation shown in FIG. 10, the logic circuit 1000 includes a switch 908, a latch 1002 having a reset input 1004, and a push button 1006 operatively connected to the reset input 1004 of the latch 1000. However, the latch 1002 is operatively connected between the one or more logic OR gates 902, 904, and 906 and the switch 908, such that the latch 1002 receives the warning signal 922 and holds the warning signal 922 for output to the control input 910 of the switch 908 until a user actuates the push button 1006 to reset the latch 1000. The switch 908 functions the same as in the logic circuit 900 except the switch 908 disengages the operation of the tool 50 when the warning signal 922 is latched by the latch 1000. Thus, in this implementation, the logic circuit 100 is able to disengage the operation of the tool 50 until the user resets the latch 1000 by actuating the push button 1006. To eliminate any race condition associated with resetting the latch 1000, the push button 1006 may include a delay circuit (not shown in the figures) to allow the system 100 to process the signals from the accelerometers 200, 202, and 204 and generate the warning signal 322 in accordance with the present invention before allowing the latch 1000 to be reset by the actuation of the push button 1006.

As shown in FIG. 10, the movement monitor system 100 may also include a lamp 1008 operatively connected to the logic circuit 900 or 1000 such that the lamp 1008 provides a visual indication when the logic circuit 900 or 1000 generates the warning signal 322. In addition, the system 100 may include an alarm device 1010 operatively configured to receive the warning signal 322 from the logic circuit 900 or 1000 and to generate an audible signal 1012 in response to receiving the warning signal 322.

Figure 11:
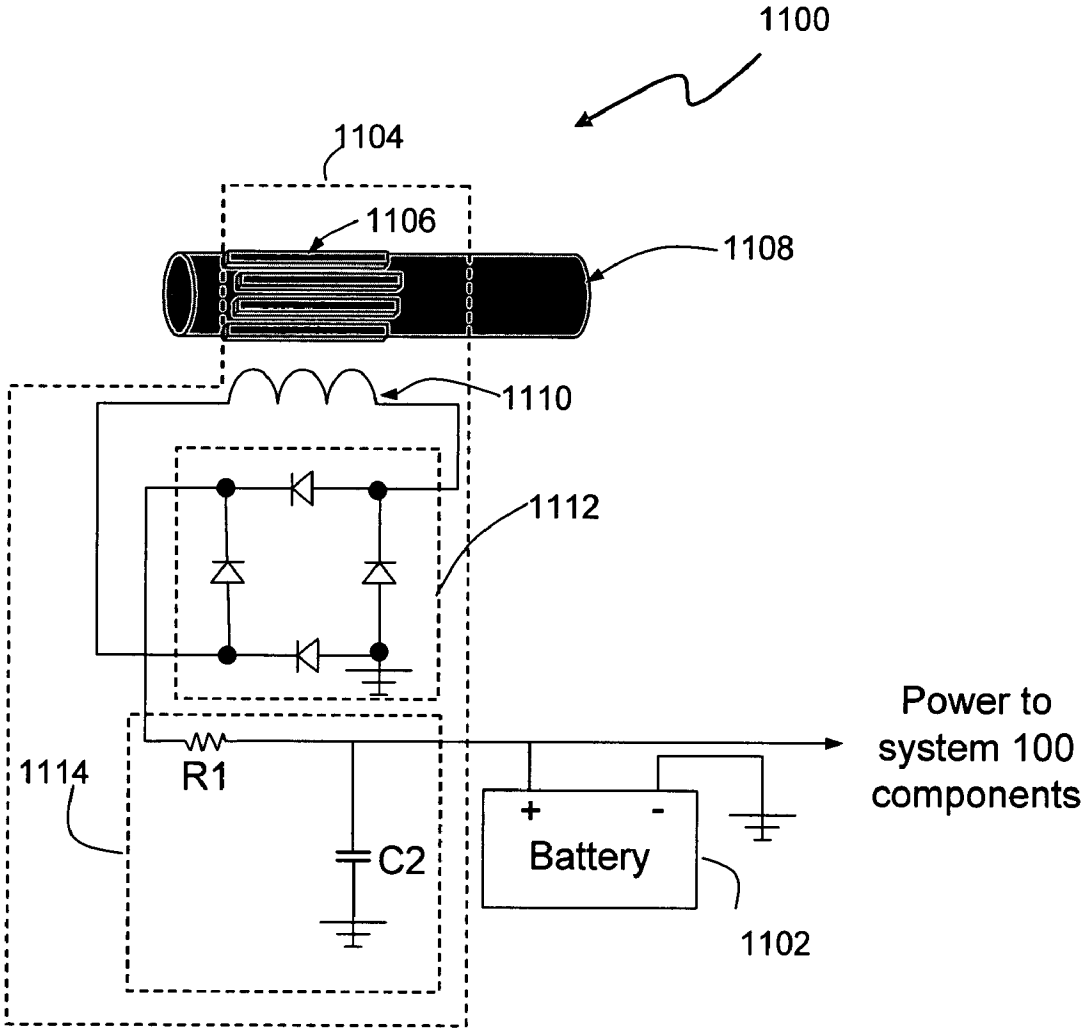
FIG. 11 depicts a schematic diagram of an exemplary power source suitable for use in the movement monitor system of FIG. 1 in accordance with the present invention.

FIG. 11 depicts a schematic diagram of an exemplary power source 1100 for use in the movement monitor system 100 in accordance with the present invention. The power source 1100 may be used to provide power to components of the system 100, such as the logic circuit 315, when the power tool 50 is operated under a power source other than electrical or pneumatic power, such as a battery separate from or included in the power source 1100. As shown in FIG. 11, the power source 1100 includes a battery 1102 operatively connected to one or more of the system 100 components (e.g., the logic circuit 315) and a power generator 1104 operatively connected to the battery 1102. The power generator 1104 has a magnet 1106 attached to a movable mechanism 1108 of the power tool 50, such as a tool shaft of a nail gun that moves to eject a nail. The power generator 1104 also has an inductor 1110 operatively connected to the battery 1102 and disposed in proximity to the magnet 1106, such that the inductor 1110 generates an alternating current (AC) signal to charge the battery 1102 when the magnet 1106 moves in relation to the inductor 1110. The power generator 1104 may also include a rectifier 1112, such as a full-wave bridge rectifier, operatively connected between the inductor 1110 and the battery 1102. The rectifier 1112 converts the AC signal generated by the inductor 1110 to a DC voltage signal to charge the battery 1102. The power generator 1100 may also include a filter

1114, such as an RC filter, operatively connected between the rectifier 1112 and the battery 1102 to provide a more stable DC voltage signal to the battery 1102.

Figure 12:
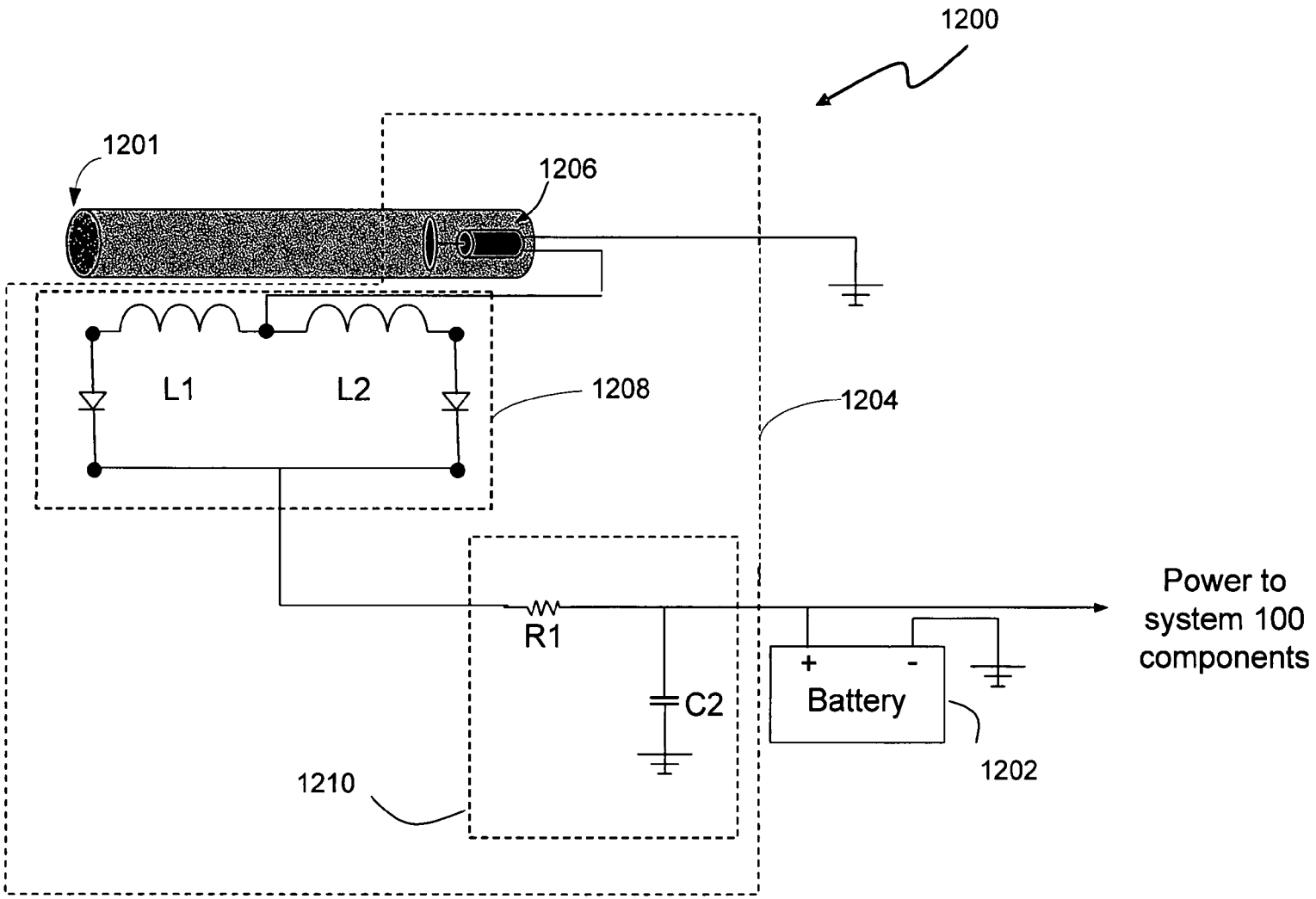
FIG. 12 depicts a schematic diagram of another exemplary power source suitable for use in the movement monitor system of FIG. 1 in accordance with the present invention.

FIG. 12 depicts a schematic diagram of another exemplary power source 1200 for use in the movement monitor system 100 in accordance with the present invention. The power source 1200 may be used to provide power to components of the system 100, such as the logic circuit 315, when the power tool 50 is operated under a power source other than electrical or hydraulic power. For example, power source 1200 may be implemented in a power tool operated by a pneumatic source 1201, such as nail gun operated by an air compressor. As shown in FIG. 12, the power source 1200 includes a battery 1202 operatively connected to one or more of the system 100 components (e.g., the logic circuit 315) and a power generator 1204 operatively connected to the battery 1202. The power generator 1204 also has a turbine 1206 disposed to receive gas or air from the pneumatic source 1201. When the turbine 1206 receives gas from the pneumatic source, the turbine 1206 generates an AC current signal to charge the battery 1202 via the power generator 1204. The power generator 1004 also may include a rectifier 1208, such as a standard full-wave rectifier, operatively connected between the turbine 1206 and the battery 1202. The rectifier 1208 converts the AC signal generated by the turbine 1206 to a DC voltage signal to charge the battery 1202. The power generator 1200 may also include a filter 1210, such as an RC filter, operatively connected between the rectifier 1208 and the battery 1202 to provide a more stable DC voltage signal to the battery 1202.

The foregoing description of an implementation of the invention has been presented for purposes of illustration and description. It is not exhaustive and does not limit the invention to the precise form disclosed. Modifications and variations are possible in light of the above teachings or may be acquired from practicing of the invention. Additionally, the described implementation includes software but the present invention may be implemented as a combination of hardware and software or in hardware alone. Note also that the implementation may vary between systems. The claims and their equivalents define the scope of the invention.

What is claimed is:

1. A power tool movement monitor system, comprising:

a first accelerometer having an output and operatively configured to sense movement along a first axis of a power tool;

a first high pass filter operatively connected to the output of the first accelerometer, the first high pass filter having an output and a cutoff frequency corresponding to a predetermined acceleration limit capable of being output by the first accelerometer;

a first low pass filter operatively connected to the output of the first accelerometer, the first low pass filter having an output and a cutoff frequency corresponding to another predetermined acceleration limit capable of being output by the first accelerometer, wherein the logic circuit is operatively configured to generate the warning signal when the first low pass filter outputs a signal having a frequency equal to or less than the cutoff frequency of the first low pass filter for a predefined period;

a logic circuit operatively configured to generate a warning signal when the first high pass filter outputs a signal having a frequency equaling or exceeding the cutoff frequency of the first high pass filter;

a voltage integrator operatively connected between the first low pass filter and the logic circuit, and a voltage comparator operatively connected between the voltage integrator and the logic circuit, the voltage comparator having a bias voltage corresponding to a voltage limit derived from the predetermined acceleration limit over the predefined period.

2. A power tool movement monitor system, comprising:

a first accelerometer having an output and operatively configured to sense movement along a first axis of a power tool;

a first high pass filter operatively connected to the output of the first accelerometer, the first high pass filter having an output and a cutoff frequency corresponding to a predetermined acceleration limit capable of being output by the first accelerometer; and a logic circuit operatively configured to generate a warning signal when the first high pass filter outputs a signal having a frequency equaling or exceeding the cutoff frequency of the first high pass filter;

a battery operatively connected to the logic circuit; and a power generator operatively connected to the battery, the power generator having:

a magnet attached to a movable mechanism of the power tool; and an inductor operatively connected to the battery and disposed in proximity to the magnet, such that the inductor generates a current to charge the battery when the magnet moves relative to the inductor.

3. A power tool movement monitor system, the power tool operated by gas from a pneumatic source, comprising:

a first accelerometer having an output and operatively configured to sense movement along a first axis of a power tool;

a first high pass filter operatively connected to the output of the first accelerometer, the first high pass filter having an output and a cutoff frequency corresponding to a predetermined acceleration limit capable of being output by the first accelerometer;

a logic circuit operatively configured to generate a warning signal when the first high pass filter outputs a signal having a frequency equaling or exceeding the cutoff frequency of the first high pass filter;

a battery operatively connected to the logic circuit; and a power generator operatively connected to the battery, the power generator having a turbine operatively connected to the battery and disposed to receive gas from the pneumatic source, wherein the turbine generates a current to charge the battery when the turbine receives gas from the pneumatic source.

4. A power tool movement monitor system, comprising:

a first accelerometer having an output and operatively configured to sense movement along a first axis of a power tool;

a first low pass filter operatively connected to the output of the first accelerometer and having an output and a cutoff frequency corresponding to a predetermined acceleration limit capable of being output by the first accelerometer;

a logic circuit operatively configured to generate a warning signal when the first low pass filter outputs a signal having a frequency equal to or less than the cutoff frequency of the first low pass filter for a predefined period;

a voltage integrator operatively connected between the first low pass filter and the logic circuit; and a voltage comparator operatively connected between the voltage integrator and the logic circuit, the voltage comparator having a bias voltage corresponding to a voltage limit derived from the predetermined acceleration limit during the predefined period.

5. A power tool movement monitor system of claim 4, wherein:

the first axis is one of a plurality of axes of the power tool;

the first accelerometer is one of a plurality of accelerometers, each accelerometer having an output and being operatively configured to sense movement along a respective one of the axes of the power tool; and the first high pass filter is one of a plurality of high pass filters, each high pass filter being operatively connected to the output of a respective one of the accelerometers and having an output and a cutoff frequency corresponding to a respective one of a plurality of predetermined acceleration limits associated with the axes of the power tool, wherein the logic circuit is operatively configured to generate the warning signal when one of the high pass filters outputs a signal having a frequency equaling or exceeding the cutoff frequency of the respective high pass filter.

6. A power tool movement monitor system of claim 4, further comprising:

a first high pass filter operatively connected to the output of the first accelerometer, the first high pass filter having an output and a cutoff frequency corresponding to another predetermined acceleration limit capable of being output by the first accelerometer, wherein the logic circuit is operatively configured to generate the warning signal when the first high pass filter outputs a signal having a frequency equaling or exceeding the cutoff frequency of the first high pass filter for a predefined period.

7. A power tool movement monitor system of claim 6, further comprising a frequency-to-voltage converter operatively connected between the first high pass filter and the logic circuit.

8. A power tool movement monitor system of claim 7, wherein the voltage comparator includes an operational amplifier having an input operatively connected to the output of the frequency-to-voltage converter.

9. A power tool movement monitor system of claim 4, wherein:

the first axis is one of a plurality of axes of the power tool;

the first accelerometer is one of a plurality of accelerometers, each accelerometer having an output and being operatively configured to sense movement along a respective one of the axes of the power tool; and the first low pass filter is one of a plurality of low pass filters, each low pass filter being operatively connected to the output of a respective one of the accelerometers and having an output and a cutoff frequency corresponding to a respective one of a plurality of predetermined acceleration limits associated with the axes of the power tool, wherein the logic circuit is operatively configured to generate the warning signal when one of the low pass filters outputs a signal having a frequency equal to or less than the cutoff frequency of the respective low pass filter for the predefined period.

10. A power tool movement monitor system of claim 9, wherein each predetermined acceleration limit is unique to the axis of the power tool of which the predetermined acceleration limit is associated.

11. A power tool movement monitor system of claim 4, further comprising a switch having a control input operatively connected to receive the warning signal from the logic circuit and an output operatively connected to a power source of the power tool, such that the switch turns off the power tool in response to receiving the warning signal on the control input.

12. A power tool movement monitor system of claim 4, further comprising an alarm device operatively configured to receive the warning signal from the logic circuit and to generate an audible signal in response to receiving the warning signal.

13. A power tool movement monitor system of claim 4, further comprising a lamp operatively connected to the logic circuit such that the lamp provides a visual indication when the logic circuit generates the warning signal.

14. A power tool movement monitor system, comprising:

a first accelerometer having an output and operatively configured to sense movement along a first axis of a power tool;

a first low pass filter operatively connected to the output of the first accelerometer and having an output and a cutoff frequency corresponding to a predetermined acceleration limit capable of being output by the first accelerometer; and a logic circuit operatively configured to generate a warning signal when the first low pass filter outputs a signal having a frequency equal to or less than;

the cutoff frequency of the first low pass filter for a predefined period; and a predetermined acceleration over a predefined period;

a voltage integrator coupled with the first low pass filter and the logic circuit; and a voltage comparator coupled with the voltage integrator and the logic circuit, the voltage comparator having a bias voltage corresponding to a voltage limit derived from the predetermined acceleration limit during the predefined period.

15. A power tool movement monitor system of claim 14, further comprising:

a first high pass filter operatively connected to the output of the first accelerometer, the first high pass filter having an output and a cutoff frequency corresponding to another predetermined acceleration limit capable of being output by the first accelerometer, wherein the logic circuit is operatively configured to generate the warning signal when the first high pass filter outputs a signal having a frequency equaling or exceeding the cutoff frequency of the first high pass filter.

16. A power tool movement monitor system of claim 15, further comprising a frequency-to-voltage converter operatively connected between the first high pass filter and the logic circuit.

17. A power tool movement monitor system of claim 16, further comprising a voltage comparator operatively connected between the frequency-to-voltage converter and the logic circuit, the voltage comparator having a bias voltage corresponding to the other predetermined acceleration limit.

18. A power tool movement monitor system of claim 14, further comprising a switch having a control input operatively connected to receive the warning signal from the logic circuit and an output operatively connected to a power source of the power tool, such that the switch turns off the power tool in response to receiving the warning signal on the control input.

* * * * *